US007513955B2

(12) United States Patent
Krüger et al.

(10) Patent No.: US 7,513,955 B2
(45) Date of Patent: Apr. 7, 2009

(54) PROCESS FOR THE PLASMA CLEANING OF A COMPONENT

(75) Inventors: Ursus Krüger, Berlin (DE); Ralph Reiche, Berlin (DE); Jan Steinbach, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 397 days.

(21) Appl. No.: 10/591,512

(22) PCT Filed: Feb. 9, 2005

(86) PCT No.: PCT/EP2005/001301

§ 371 (c)(1),
(2), (4) Date: Sep. 1, 2006

(87) PCT Pub. No.: WO2005/084830

PCT Pub. Date: Sep. 15, 2005

(65) Prior Publication Data

US 2007/0215174 A1 Sep. 20, 2007

(30) Foreign Application Priority Data

Mar. 2, 2004 (EP) ..... 04004892

(51) Int. Cl.
*B08B 3/12* (2006.01)
*B08B 6/00* (2006.01)
*B08B 7/00* (2006.01)
*B08B 7/02* (2006.01)

(52) U.S. Cl. ..... 134/1; 134/1.1; 134/19; 134/22.1

(58) Field of Classification Search ..... None
See application file for complete search history.

(56) References Cited

U.S. PATENT DOCUMENTS

| | | | | |
|---|---|---|---|---|
| 4,098,450 | A | 7/1978 | Keller et al. | |
| 4,121,894 | A * | 10/1978 | Cretella et al. | 416/213 R |
| 4,141,127 | A * | 2/1979 | Cretella et al. | 29/889.1 |
| 7,451,774 | B2 * | 11/2008 | Verhaverbeke et al. | 134/184 |
| 2005/0035085 | A1 * | 2/2005 | Stowell et al. | 216/76 |

FOREIGN PATENT DOCUMENTS

| | | | |
|---|---|---|---|
| EP | 0 313 855 | A2 | 5/1989 |
| EP | 0 740 989 | A2 | 11/1996 |
| EP | 1 135 540 | B1 | 9/2001 |
| FR | 2 836 157 | A1 | 8/2003 |

* cited by examiner

*Primary Examiner*—Duy-Vu N Deo

(57) ABSTRACT

Cracks are conventionally difficult to clean which often leads to damage to other regions of the component for cleaning. According to the invention, a plasma cleaning method is used, whereby a pressure and/or a separation of an electrode to the component are varied, in order to achieve a plasma cleaning in the crack.

8 Claims, 4 Drawing Sheets

PROCESS FOR THE PLASMA CLEANING OF A COMPONENT

CROSS REFERENCE TO RELATED APPLICATIONS

This application is the US National Stage of International Application No. PCT/EP2005/001301, filed Feb. 9, 2005 and claims the benefit thereof. The International Application claims the benefits of European Patent application No. 04004892.8 filed Mar. 2, 2004. All of the applications are incorporated by reference herein in their entirety.

FIELD OF THE INVENTION

The invention relates to a process for the plasma cleaning of a component as described in the claims.

BACKGROUND OF THE INVENTION

Surfaces of components often have to have contaminants removed from them for application of or in intermediate steps of various processes. The contaminants may be grains of dust, oil or grease films or corrosion products on the surface of the component. Simple wiping or dry ice blasting processes are known as prior art. However, if a recess or a crack is to be cleaned, it is necessary to employ more complex processes. This is done for example by fluoride ion cleaning (FIC), hydrogen annealing or salt bath cleaning. In these processes, which entail considerable outlay on apparatus, the surfaces which are not to be cleaned are in some cases also adversely affected to a significant extent.

Plasma-enhanced vacuum etching processes carried out on components as part of known PVD or CVD coating processes immediately prior to the vapor deposition are known. The basic principle of this surface treatment is the atomization or sputtering of adhering contaminants and of the upper atom layers of the material to be removed to form particles of atomic size by bombardment with inert gas ions. The very finely atomized contaminant has, as it were, passed into the vapor phase and can be sucked out. Plasmas of this type can be achieved by coupling suitable electrode arrangements to high-voltage/radiofrequency generators. However, these processes are only employed to clean planar surfaces.

EP 0 313 855 A2 discloses a process for generating a gas plasma in which the voltage is controlled to a specific value.

EP 0 740 989 A2 discloses a method for cleaning a vulcanization mold, in which a plasma flow is generated.

SUMMARY OF THE INVENTION

Therefore, it is an object of the invention to provide a process which allows a crack to have contaminants removed from it more easily and more quickly without other regions of the component being adversely affected.

This object is achieved by the plasma cleaning process as claimed in the claims.

The subclaims list further advantageous process steps of the process according to the invention. The measures listed in the subclaims can be combined with one another in advantageous ways.

DETAILED DESCRIPTION OF THE INVENTION

Figure 1:
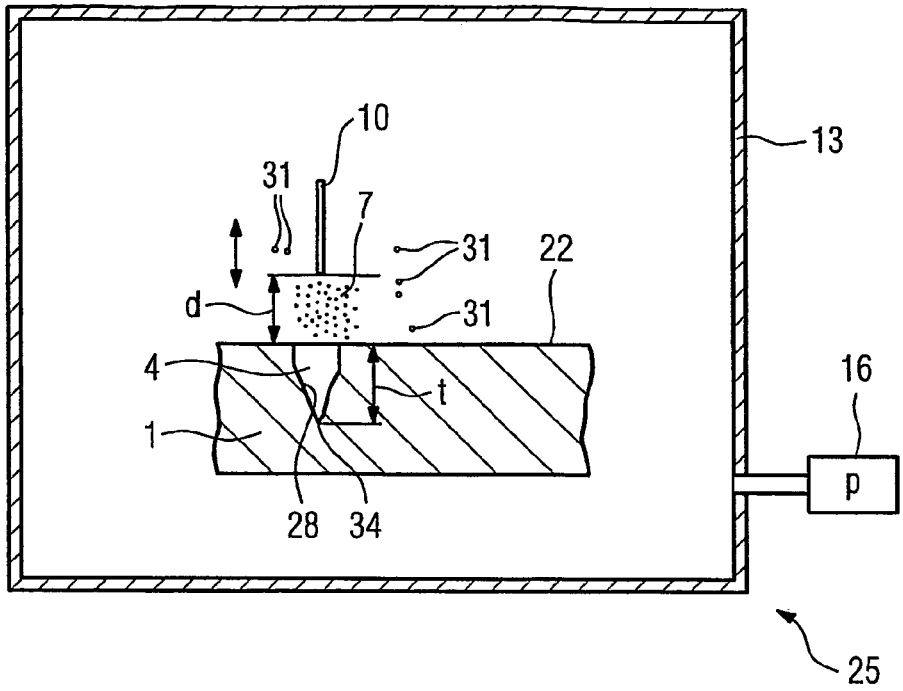
FIGS. 1, 2 show apparatuses for carrying out the process according to the invention.

FIG. 1 shows an example of an apparatus 25 for carrying out the process according to the invention. It comprises a chamber 13 in which a vacuum p is present. The vacuum p is generated by a pump 16, which is connected to the chamber 13. In the chamber 13 there is a component 1, which has a crack 4 starting from a surface 22.

There is also an electrode 10 arranged above the surface 22 of a component 1 in order to initiate and maintain a plasma 7. This electrode 10 is at a certain distance d from the surface 22 of the component 1. The condition that the product of distance times pressure must be constant ($d \times p = \text{const.}$) is required to maintain a plasma 7.

Since the crack 4 has a certain depth t down to the crack tip 34, the inner surface 28 of the crack 4 is not completely covered by the plasma 7, since the distance from the electrode 10 to the outer surface 22 of the component 1 and the distance to the crack tip 34 of the crack 4 differ.

Therefore, by way of example, the distance d from the electrode 10 to the surface 22 is varied, so that the plasma 7 migrates from the crack tip to the surface 22 or from the surface 22 of the component 1 to the crack tip 37 of the crack 4. In this way, the distance d can be reduced, in particular continuously, so that the plasma 7 migrates from the surface 22 into the crack 4.

A reactive gas 31, which for example reacts with a corrosion product in the crack 4 and thereby promotes cleaning of the crack 4, may likewise be present in the chamber 13.

The component 1 may be metallic or ceramic. In particular, the component 1 is an iron-base, cobalt-base or nickel-base superalloy, which serves for example to produce a turbine blade or vane 12, 130 (FIGS. 3, 5) or combustion chamber lining 155 (FIG. 4) of a turbine 100 (FIG. 5). Further components of a gas or steam turbine can be cleaned using this process. Cracks 4 in the component 1 may be present immediately after production or may have formed after the component 1 has been in operational use.

Worn components 1, 120, 130, 155 of this type are often refurbished. In this case, corrosion products are removed from the surface 22. Corrosion products in the crack 4 are more difficult to remove.

After the crack 4 has been cleaned using the process according to the invention, the crack 4 can be welded or soldered up, since the solder can bond very well to a cleaned surface.

Figure 2:
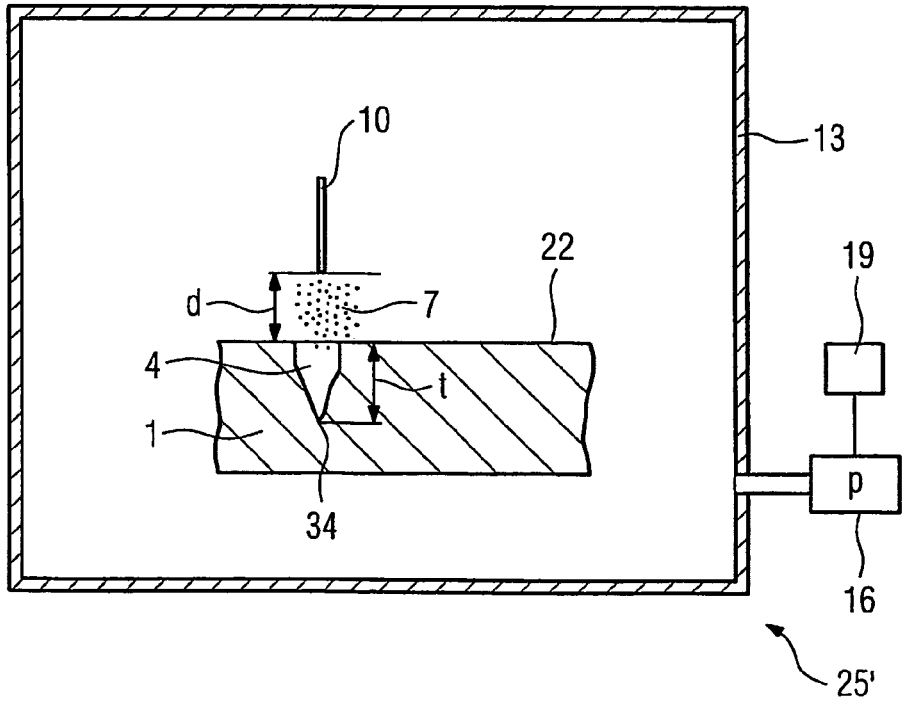

FIG. 2 shows a further apparatus 25' which can be used to carry out the process according to the invention. The apparatus 25' has a control unit 19 which regulates the pressure p in the chamber 13. Since the condition "distance times pressure equals constant" applies to the maintaining of a plasma 7, it is also possible to vary the pressure p in order to initiate and maintain a plasma 7 in the crack 4 if the distance d between electrode 10 and surface 22 is fixed. By, for example, continuously reducing the pressure p, the plasma 7 is made to migrate ever deeper toward the crack tip 34 of the crack 4.

A reactive gas 31, which for example reacts with a corrosion product in the crack 4 and thereby promotes cleaning of the crack 4, may likewise be present in the chamber 13.

Another possibility is for pressure and distance to be varied simultaneously, in such a way that the plasma 7 is maintained, although it is still necessary to comply with the condition for maintaining a plasma 7 (distance times pressure equals constant).

The distance d and the pressure p can be varied simultaneously or alternately.

An inert gas (Ar, $H_2$, $N_2$, etc.) may be present in the chamber 13.

Figure 3:
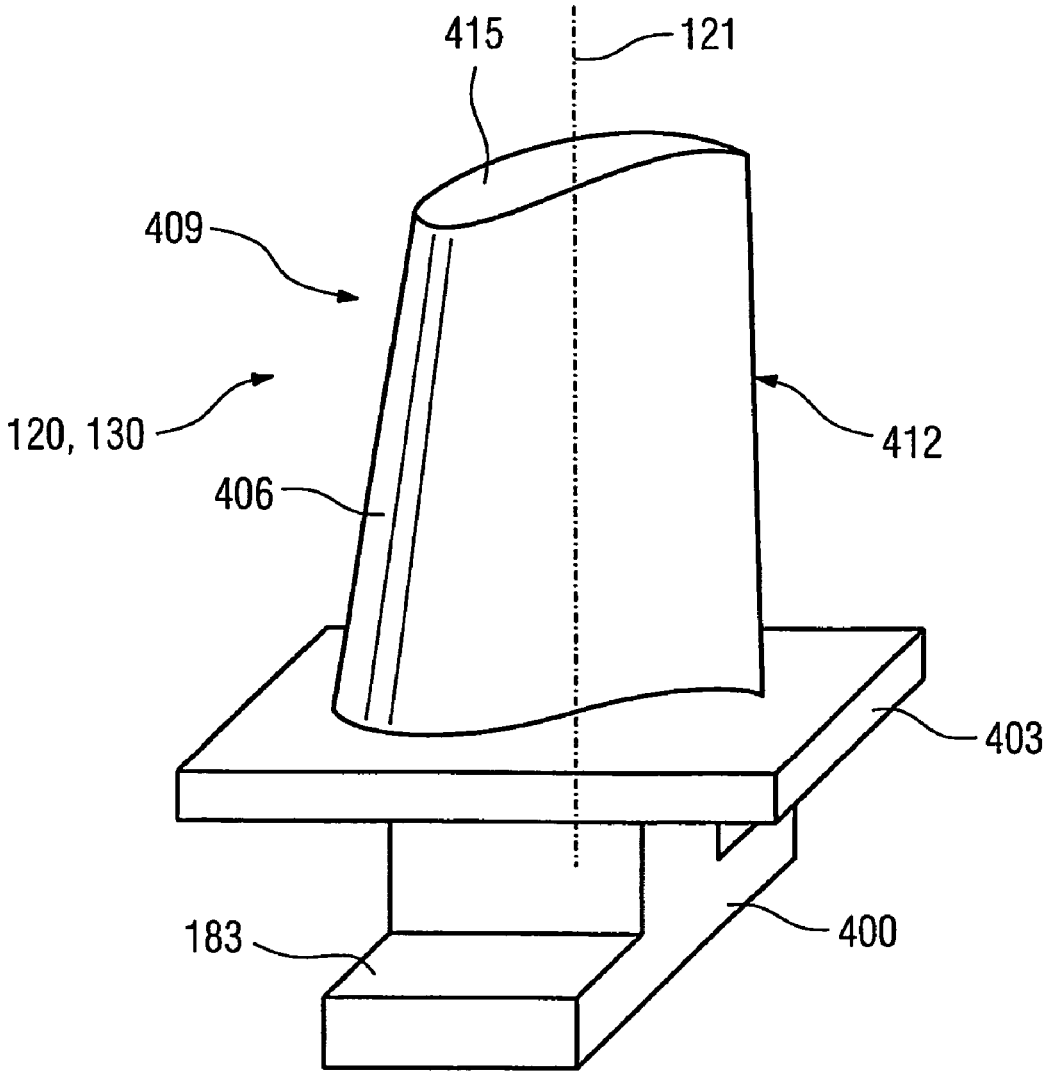
FIG. 3 shows a turbine blade or vane.

FIG. 3 shows a perspective view of a blade or vane 120, 130 which extends along a longitudinal axis 121.

For generation of plasma, the blade 120 may be a rotor blade 120 or a guide vane 130 of a turbomachine. The turbomachine may be a gas turbine of an aircraft or of a power plant for generating electricity, a steam turbine or a compressor.

The blade or vane 120, 130 has, in succession along the longitudinal axis 121, a securing region 400, an adjoining blade or vane platform 403 and a main blade or vane part 406. As a guide vane 130, the vane 130 may have a further platform (not shown) at its vane tip 415.

A blade or vane root 183, which is used to secure the rotor blades 120, 130 to a shaft or a disk (not shown), is formed in the securing region 400. The blade or vane root 183 is designed, for example, in hammerhead form. Other configurations, such as a fir-tree or dovetail root, are possible. The blade or vane 120, 130 has a leading edge 409 and a trailing edge 412 for a medium which flows past the main blade or vane part 406.

In the case of conventional blades or vanes 120, 130, by way of example solid metallic materials are used in all regions 400, 403, 406 of the blade or vane 120, 130. The blade or vane 120, 130 may in this case be produced by a casting process, also by means of directional solidification, by a forging process, by a milling process or combinations thereof.

Workpieces with a single-crystal structure or structures are used as components for machines which, in operation, are exposed to high mechanical, thermal and/or chemical stresses. Single-crystal workpieces of this type are produced, for example, by directional solidification from the melt. This involves casting processes in which the liquid metallic alloy solidifies to form the single-crystal structure, i.e. the single-crystal workpiece, or solidifies directionally. In this case, dendritic crystals are oriented along the direction of heat flow and form either a columnar crystalline grain structure (i.e. grains which run over the entire length of the workpiece and are referred to here, in accordance with the language customarily used, as directionally solidified) or a single-crystal structure, i.e. the entire workpiece consists of one single crystal. In these processes, a transition to globular (polycrystalline) solidification needs to be avoided, since non-directional growth inevitably forms transverse and longitudinal grain boundaries, which negate the favorable properties of the directionally solidified or single-crystal component.

Where the text refers in general terms to directionally solidified microstructures, this is to be understood as meaning both single crystals, which do not have any grain boundaries or at most have small-angle grain boundaries, and columnar crystal structures, which do have grain boundaries running in the longitudinal direction but do not have any transverse grain boundaries. This second form of crystalline structures is also described as directionally solidified microstructures (directionally solidified structures).

Processes of this type are known from U.S. Pat. No. 6,024,792 and EP 0 892 090 A1.

Refurbishment means that after they have been used, protective layers may have to be removed from components 120, 130 (e.g. by sand-blasting). Then, the corrosion and/or oxidation layers and products are removed. If appropriate, cracks in the component 120, 130 are also repaired. This is followed by recoating of the component 120, 130, after which the component 120, 130 can be reused.

The blade or vane 120, 130 may be hollow or solid in form. If the blade or vane 120, 130 is to be cooled, it is hollow and may also have film-cooling holes (not shown).

To protect against corrosion, the blade or vane 120, 130 has, for example, corresponding, generally metallic coatings, and to protect against heat it generally also has a ceramic coating.

Figure 4:
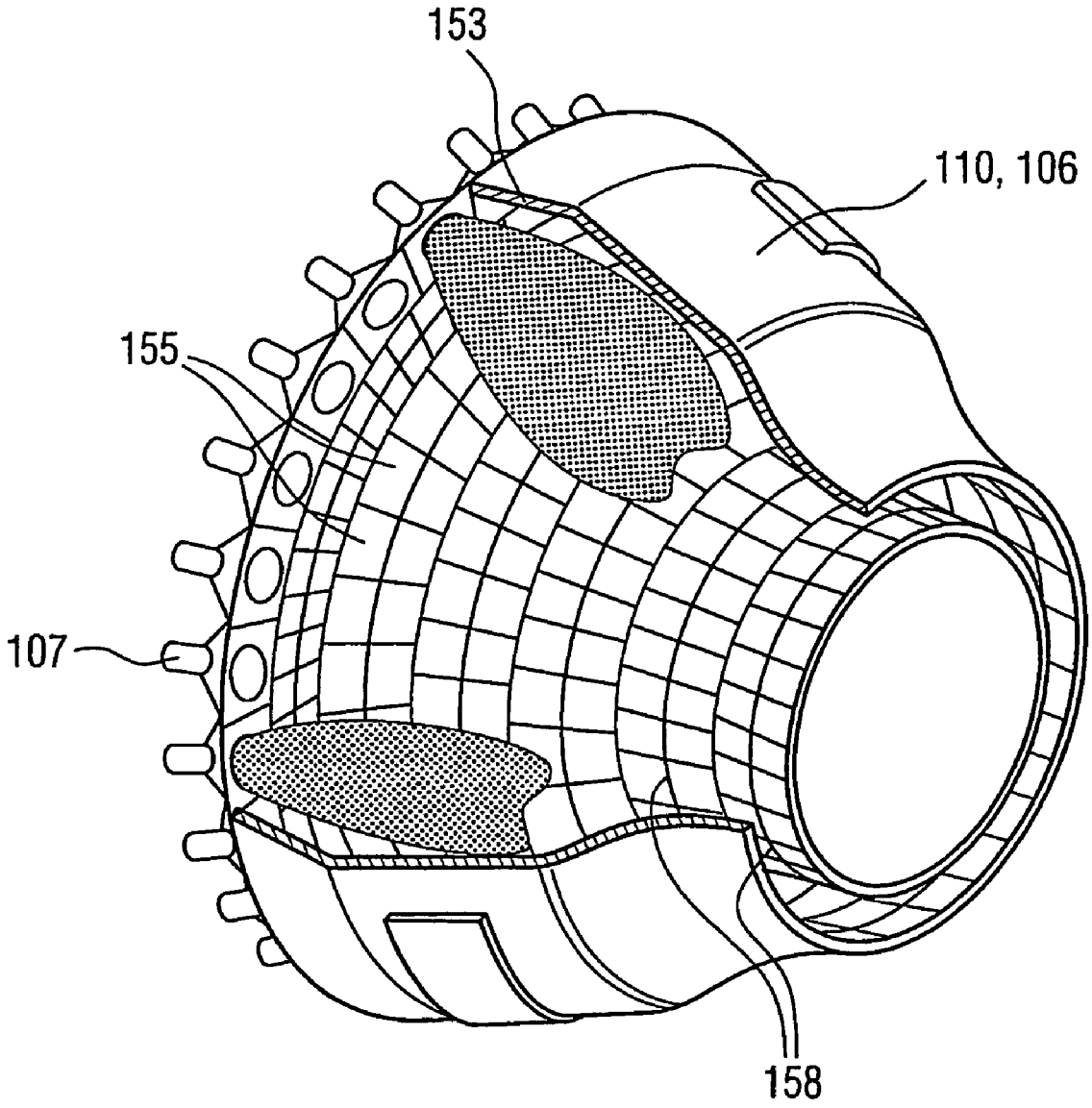
FIG. 4 shows a combustion chamber.
Figure 5:
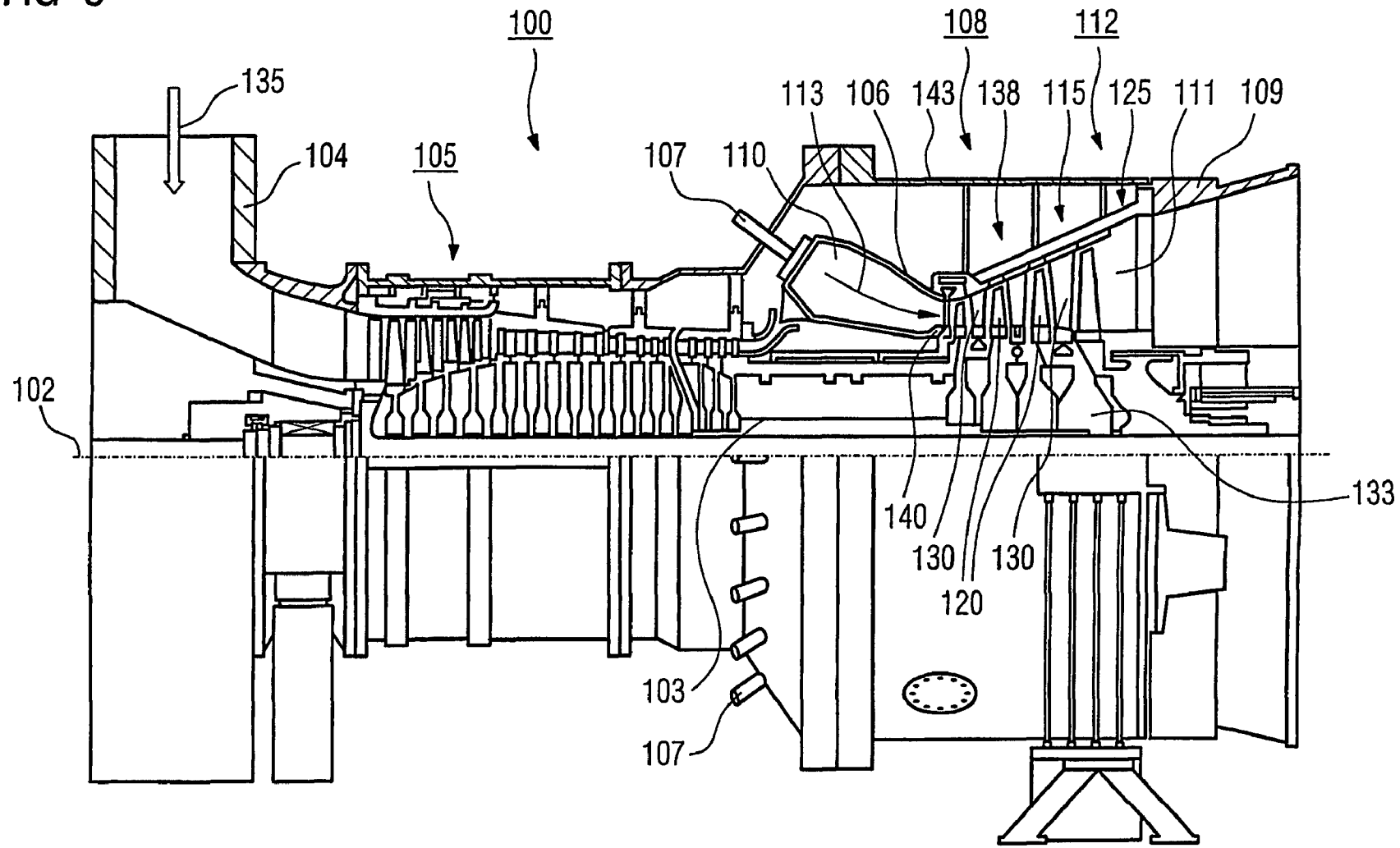
FIG. 5 shows a gas turbine.

FIG. 4 shows a combustion chamber 110 of a gas turbine. The combustion chamber 110 is configured, for example, as what is known as an annular combustion chamber, in which a multiplicity of burners 102 arranged circumferentially around the turbine shaft 103 open out into a common combustion chamber space. For this purpose, the combustion chamber 110 overall is of annular configuration positioned around the turbine shaft 103.

To achieve a relatively high efficiency, the combustion chamber 110 is designed for a relatively high temperature of the working medium M of approximately 1000° C. to 1600° C. To allow a relatively long service life even with these operating parameters, which are unfavorable for the materials, the combustion chamber wall 153 is provided, on its side which faces the working medium M, with an inner lining formed from heat shield elements 155. On the working medium side, each heat shield element 155 is equipped with a particularly heat-resistant protective layer or is made from material that is able to withstand high temperatures. Moreover, a cooling system is provided for the heat shield elements 155 and/or for their holding elements, on account of the high temperatures in the interior of the combustion chamber 110.

The materials of the combustion chamber wall and their coatings may be similar to those of the turbine blades or vanes.

The combustion chamber 110 is designed in particular to detect losses of the heat shield elements 155. For this purpose, a number of temperature sensors 158 are positioned between the combustion chamber wall 153 and the heat shield elements 155.

FIG. 5 shows, by way of example, a partial longitudinal section through a gas turbine 100. In the interior, the gas turbine 100 has a rotor 103 which is mounted such that it can rotate about an axis of rotation 102 and is also referred to as the turbine rotor. An intake housing 104, a compressor 105, a, for example, toroidal combustion chamber 110, in particular an annular combustion chamber 106, with a plurality of coaxially arranged burners 107, a turbine 108 and the exhaust-gas housing 109 follow one another along the rotor 103. The annular combustion chamber 106 is in communication with a, for example, annular hot-gas passage 111, where, by way of example, four successive turbine stages 112 form the turbine 108. Each turbine stage 112 is formed, for example, from two blade or vane rings. As seen in the direction of flow of a working medium 113, in the hot-gas passage 111 a row of guide vanes 115 is followed by a row 125 formed from rotor blades 120.

The guide vanes 130 are secured to an inner housing 138 of a stator 143, whereas the rotor blades 120 of a row 125 are fitted to the rotor 103 for example by means of a turbine disk 133. A generator (not shown) is coupled to the rotor 103.

While the gas turbine 100 is operating, the compressor 105 sucks in air 135 through the intake housing 104 and compresses it. The compressed air provided at the turbine-side end of the compressor 105 is passed to the burners 107, where it is mixed with a fuel. The mix is then burnt in the combustion chamber 110, forming the working medium 113. From there, the working medium 113 flows along the hot-gas passage 111 past the guide vanes 130 and the rotor blades 120. The working medium 113 is expanded at the rotor blades 120, transferring its momentum, so that the rotor blades 120 drive the rotor 103 and the latter in turn drives the generator coupled to it.

While the gas turbine 100 is operating, the components which are exposed to the hot working medium 113 are subject to thermal stresses. The guide vanes 130 and rotor blades 120 of the first turbine stage 112, as seen in the direction of flow of the working medium 113, together with the heat shield bricks which line the annular combustion chamber 106, are subject to the highest thermal stresses. To be able to withstand the temperatures which prevail there, they have to be cooled by means of a coolant. Substrates of the components may likewise have a directional structure, i.e. they are in single-crystal form (SX structure) or have only longitudinally oriented grains (DS structure). By way of example, iron-base, nickel-base or cobalt-base superalloys are used as material for the components, in particular for the turbine blade or vane 120, 130 and components of the combustion chamber 110. Superalloys of this type are known, for example, from EP 1 204 776, EP 1 306 454, EP 1 319 729, WO 99/67435 or WO 00/44949; these documents form part of the disclosure.

The blades or vanes 120, 130 may also have coatings which protect against corrosion (MCrAlX; M is at least one element selected from the group consisting of iron (Fe), cobalt (Co), nickel (Ni), X is an active element and represents yttrium (Y) and/or silicon and/or at least one rare earth element) and against heat by means of a thermal barrier coating. The thermal barrier coating consists for example of $ZrO_2$, $Y_2O_4$—$ZrO_2$, i.e. unstabilized, partially stabilized or fully stabilized by yttrium oxide and/or calcium oxide and/or magnesium oxide.

Columnar grains are produced in the thermal barrier coating by suitable coating process, such as for example electron beam physical vapor deposition (EB-PVD).

The guide vane 130 has a guide vane root (not shown here) which faces the inner housing 138 of the turbine 108, and a guide vane head which is at the opposite end from the guide vane root. The guide vane head faces the rotor 103 and is fixed to a securing ring 140 of the stator 143.

The invention claimed is:

1. A method for cleaning a component by a plasma, comprising:

arranging the component in a chamber having a chamber pressure and an electrode, where the component has a crack that initiates from a surface of the component and the component is arranged at a distance from the electrode as a function a depth of the crack;

initiating the plasma via the electrode within the chamber; and varying the distance from the electrode to the component while not varying the chamber pressure, or the chamber pressure while not varying the distance from the electrode to the component, or both the distance from the electrode to the component and the chamber pressure such that a product of the chamber pressure and the distance from the electrode to the component is not varied.

2. The method as claimed in claim 1, wherein the distance from the electrode to the surface of the component is continuously reduced to clean the crack of the component.

3. The method as claimed in claim 1, wherein the chamber pressure is continuously reduced to clean the crack of the component.

4. The method as claimed in claim 1, wherein the chamber is supplied with a reactive gas that reacts with a product to be removed from the crack of the component.

5. The method as claimed in claim 1, wherein the component is selected from the group consisting of: a turbine blade, a turbine vane, a combustion chamber wall and a gas turbine housing.

6. The method as claimed in claim 5, wherein the component is a used part to be refurbished.

7. The method as claimed in claim 1, wherein the chamber pressure is less than an ambient pressure surrounding the chamber.

8. The method as claimed in claim 1, wherein the chamber pressure and the distance from the electrode to the component is controlled such that the plasma is maintained.

* * * * *